US005778896A

United States Patent [19]

Seals et al.

[11] Patent Number: 5,778,896

[45] Date of Patent: Jul. 14, 1998

[54] SMOKING PIPE AND FASTENER MANIPULATING TOOL

[76] Inventors: Robert L. Seals; Michael J. Okoniewski, both of Autumn La., Chico, Calif. 95926

[21] Appl. No.: 920,412

[22] Filed: Aug. 29, 1997

Related U.S. Application Data

[60] Provisional application No. 60/024,872 Aug. 30, 1996.

[51] Int. Cl.[6] ..... A24F 1/26

[52] U.S. Cl. ..... 131/181; 131/248; 131/226; 131/178; 7/165; 81/437

[58] Field of Search ..... 131/248, 226, 131/181, 227, 225, 229, 178, 27; 7/138, 165, 170; 81/437, 439, 177.4, 490

[56] References Cited

U.S. PATENT DOCUMENTS

| | | | |
|---|---|---|---|
| 2,629,415 | 11/1953 | Baker | 145/71 |
| 2,770,240 | 1/1956 | Stauber | 131/203 |
| 4,524,782 | 6/1985 | Chister | 131/180 |
| 4,730,626 | 3/1988 | Calkins | 131/196 |
| 5,632,056 | 5/1997 | Hsiao | 7/138 |

*Primary Examiner*—Aaron J. Lewis
*Assistant Examiner*—Charles W. Anderson

[57] ABSTRACT

A pipe for use in smoking tobacco including a hollow stem having a mouth end structured as a small tool socket for grasping nuts and bolt heads, and for holding a removable screw driver rod. A tobacco bowl at the opposite end of the stem includes a sidewall defining an open mouth with the sidewall structured as a tool socket. The pipe can be stored by insertion into an elongated tubular hollow housing having a relatively large tool socket at one end, and a smaller tool socket at the opposite end in a sidewall of the housing. In a sidewall of the housing adjacent to the smaller socket is a receiving notch with inward extending lips. The pipe bowl extends 90 degrees to the stem and includes multiple grooves on its exterior surface to allow the bowl to be inserted into and grasped by the receiving notch lips to define a generally L-shaped or T-shaped overall tool shape for grasping by hand for use of the included sockets and screw driver. The pipe stem is removably storable within the housing with the bowl positioned in-part within the receiving notch. Also included is a reversible multitipped screw driver rod removably storable inside the pipe stem. A beverage bottle cap removing slot is provided in a sidewall of the housing. The pipe, with stored screw driver rod, stored within the housing is sufficiently small to fit easily into a pocket of an article of clothing.

5 Claims, 7 Drawing Sheets

SMOKING PIPE AND FASTENER MANIPULATING TOOL

A priority claim for common material is hereby made for this application to the earlier filing date of our pending U.S. Provisional application serial number 60/024,872 filed 08/30/96.

BACKGROUND OF THE INVENTION

1. Field of the Invention:

The present invention is a smoking pipe for use in smoking tobacco and other legal substances, with the pipe structured in combination with other elements to also provide a compact multipurpose hand tool for use in the manipulation of fasteners such as nuts, bolts, screws and the like.

2. Description of the Prior Art:

We are not aware of any tools, tool sets or like structures identical to the present multipurpose hand tool. We are not aware of any smoking pipes which are also structured to serve as tools for driving fasteners such as nuts and bolts. We are aware of many prior art socket-set style tool combinations and compact combination tool kits on the retail shelves, but none are considered similarly structured to the present invention and none provide all of the many benefits of the present invention.

SUMMARY OF THE INVENTION

The following Summary and detailed description is of a best mode and of preferred structures for carrying out the invention, and although there are clearly some changes which could be made to that which is specifically herein described and shown in the included drawings, for the sake of briefness of this disclosure all of these changes which fall within the scope of the present invention have not herein been detailed, but will become apparent to those skilled in the art with a reading of this disclosure.

The present invention is a smoking pipe for use in smoking tobacco and other legal substances, with the pipe structured to include nut and bolt head grasping sockets; the rigid stem of the pipe structured for holding a screw driver rod for driving screws; and a main housing in which to insert and store the pipe, with the main housing including multiple nut and bolt head grasping sockets, the invention providing a compact, lightweight, versatile and highly portable multipurpose hand tool for use in the manipulation of fasteners such as nuts, bolts, screws and the like, and for use in smoking tobacco when desired.

The fastener manipulating tools as herein described for example are primarily structured and sized for use on snow boards and wake boards, such as for manipulating the feet-binding fasteners, and will also function well with many skate boards, such as with the wheel mount nuts and wheel-trucks and associated fasteners, although the present tool can also be used on other equipment such as in-line skates, mountain skate boards, etc.

The present multipurpose hand tool/smoking pipe is sufficiently small to fit into the pocket of a shirt, coat, jacket or pair of pants or like article of clothing for human beings. The smoking pipe may be herein referred to as a tool since it is a tool used in the smoking of tobacco or the like smoked by humans. The compact size and light weight aspect of the present tool allows it to be carried in a pocket so the tool is readily available to make repairs and adjustments to equipment such as a snow board or skate board. This is particularly handy for snow boarders who reach the top of a ski slope or snow board run only to find the fasteners holding the bindings to the board have worked loose. The present tool will allow the fasteners of the bindings to be tightened. The present tool in its stored state, which is assembled and ready for storage in a pocket of clothing, is structured or configured to be safe to carry in a pocket, so that the person is unlikely to become injured by the tool should he or she fall during an event such as snow boarding. The present tool, when partly disassembled or reconfigured from its stored state, allows convenient pipe smoking when ever one wishes.

The present multipurpose tool has multiple sockets and screw drivers (wrenching tips) of multiple types and sizes for cooperative use with various fastener heads. The sockets and screw driver tips (wrenching tools or tips) are for wrenching on or rotating fasteners and fastener components such as bolts, nuts, screws and the like, which may be structured for grasping with wrenching tools such as hex-sockets, phillips screw drivers, straight-blade screw drivers, allen wrenches, star tipped wrenches, torx tips style wrenches, or any other known fastener-head gripping wrench. A specific example herein given and shown of a preferred embodiment tool in accordance with the present invention includes hex sockets of various sizes, a straight-blade screw driver tip, and a phillips screw driver tip for engaging appropriately shaped fastener heads to allow a human user of the tool to rotate the fastener with the present tool. The present tool is made with fastener grasping or engaging wrenching tool tips such as sockets for fitting against and external of the fastener heads, and tips such as various screw driver type tips for fitting inside slots and shaped holes in the heads of fasteners, of any known type, or of types to be invented and used in the future, in which case the present tool will be modified to include appropriate wrenching tools.

The present tool including the smoking pipe stores in a compact arrangement for storing in a small area such as a pocket, and disassembles or is re-arrangeable from its compact storage state into a smoking pipe or a multiple wrenching tipped tool arranged to provide the user good leverage to tighten or loosen fasteners such as screws and nuts and bolts and the like. A variety of different fastener wrenching tips are preferably provided on the present tool, so that, for example, the user can manipulate straight-blade type screws, phillips type screws, hex-head nuts and bolts, and the like. The present tool is structured to not have any exposed sharp points or extensions when in its compact storage state so that when stored in a clothing pocket, it will not cut into the fabric and damage the article of clothing, and additionally if it is in a pocket of a person when the person falls such as during snow boarding, the tool will not be likely to poke or otherwise injure the person.

In a preferred embodiment of the present tool, a groove or slot is provided in the main housing for use in prying off beverage bottle caps.

The weight of the tool is preferably well under two pounds, and the tool is preferably a durable and quality tool, such as made of steel or a steel alloy or another high quality material which is rigid, strong and tough.

BRIEF DESCRIPTION OF THE DRAWINGS

Drawing FIGS. 1–9 show a preferred structural embodiment in accordance with the present invention wherein:

FIG. 1 shows the present tool in a disassembled or exploded view, wherein the smoking pipe is shown above the screw driver rod which in turn is shown above the main housing of the preferred embodiment.

FIG. 2 is a side elevational view showing the FIG. 1 tool assembled into its compact easily stored state.

FIG. 3 is a back end elevational view showing the stored state tool of FIG. 2.

FIG. 4 is a front end elevational view showing the stored state tool of FIG. 2 from what is considered the front end, which is the end oppositely disposed from the back end of FIG. 3.

FIG. 5 is a top elevational view showing the stored state tool of FIG. 2.

FIG. 6 is a bottom elevational view showing the stored state tool of FIG. 2 from what is considered the bottom and oppositely disposed from that shown in FIG. 5.

FIG. 7 shows the tool having some components thereof removed from their stored state and arranged for driving or manipulating fasteners. A portion of a bolt having a hexagonal head is shown above an appropriately sized hexagonal socket of the smoking pipe. The outwardly extending portions of the tool on each side of the hexsocket are the pipe stem to the left and the main housing to the right in a T-shaped arrangement to be grasped by one or more hands of the user and to serve as leverage providing extensions.

FIG. 8 shows the tool set-up for use in a different use configuration from that of FIG. 7. The L-shape configuration provides a high leverage grasping surface for operating the screw driver tip or the sockets, one socket at the end of the main housing, and the other socket being inside the open mouth of the pipe bowl.

FIG. 9 shows the tool in its stored state and cross sectioned. An additional socket is shown on the exterior sidewall of the pipe bowl to exemplify that additional wrenching tools can be feasibly added.

DESCRIPTION OF THE PREFERRED EMBODIMENT

Figure 1:
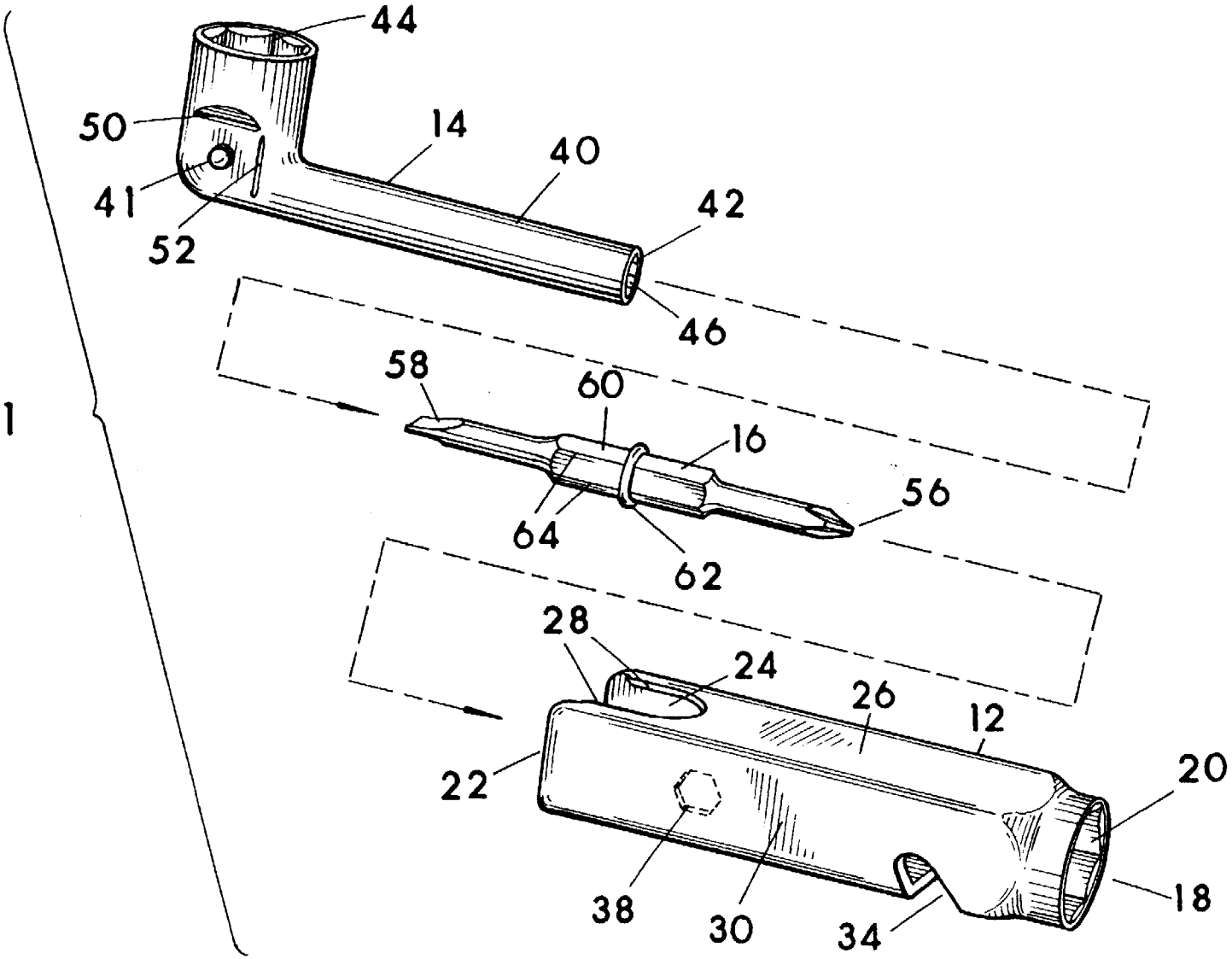

Referring now to the drawings in general for a detailed description of a structural embodiment in accordance with the present invention, and for a further description how to make and use the invention. The present multipurpose tool can be built in numerous sizes, generally speaking however one general or overall size has been found to function well in most applications, such as small enough to fit in the palm of a human hand, and to be storable in a pocket of an article of clothing. We will herein provide some dimensions in inches and portions thereof for this palm size tool to allow those skilled in the art to more easily build and use at least one tool in accordance with the present invention. The dimensions herein given are for example and are not intended to overly restrict the true scope of the invention, as clearly many of these dimensions can be readily changed in building a tool in accordance with the invention. Additionally, we will sometimes herein suggest suitable materials from which to manufacture certain components of the present invention, but it must be realized these suggested materials are not the only suitable materials which can be used in the particular suggested application. In most cases if not all, where we suggest steel; titanium, chrome-molly, aluminum or some other suitable material could be used instead of the steel, such as for weight or possibly cost considerations. Additionally, different suitable fabrication processes may be used as suitable substitutes for one another, and for example, in some cases welding which may be herein suggested can be replaced with bolting, snap-fits, riveting, or integral forming such as by casting, molding, machining and combinations thereof within the scope of the invention. The above is not an exhaustive list of alternatives to that which will herein be suggested, but is intended to allow those skilled in the art to fully realize that different materials and processes can be used to make a multipurpose tool in accordance with the present invention.

The tool 10 shown in the drawings is an example of one embodiment in accordance with the present invention. The tool in accordance with the present invention shown in the drawings can be made entirely of steel with the exception of the shown rubbery O-ring 62, which is made of rubbery material such as natural or synthetic rubber. The O-ring 62 could be replaced with a steel or metal spring ball and steel spring defining a spring ball detent.

Referring now to FIG. 1 where the component parts of the preferred embodiment are illustrated. In the drawings, multipurpose pipe/tool 10 includes three separate members: a main housing 12; the smoking pipe 14 with a combination bowl and socket 44 on one end of the stem 40; and a multi-tip reversible screw driver rod 16, all preferably manufactured of steel or chrome-molly or the like rigid tough material. Main housing 12 is an elongated tubular hollow rectangular metal sleeve or box approximately three and a half inches in length and three fourths of an inch in height and width, and is defined generally by relatively thin sidewalls. Housing 12 can be cast, machined into shape, or fabricated such as by being die-stamped from a flat sheet and then bent into shape and welded at the seam. Although housing 12 is described as rectangular or square in shape, a cylindrical configuration with a single annular sidewall could also be feasible. Housing 12 has an open front end 18 with the sidewall shaped to define an interior hexagonal socket 20 which is preferably one half inch in size, or in other words, for fitting ½" nut or bolt hex heads. Back end 22 of housing 12 includes a receiving notch 24 located on the top surface 26 thereof which is for grasping or engaging a portion of the bowl/socket 44 of pipe 14. A pair of small inwardly projecting lips 28 are located on each exposed lengthwise edge of the walls of sides 30 of housing 12 within receiving notch 24 and partially bounding notch 24, the purpose of which will be explained later. The bottom surface 32 of housing 12, adjacent front end 18, contains a transverse opening, referred to as bottle opening slot or groove, or simply bottle opener 34, with the ends of the opening extending at an angle over into both sides 30 of housing 12. Bottle opener 34 is sufficiently sized for prying on and removing the caps of most existing conventional bottled beverages having non twist type closure caps. Bottom surface 32 of housing 12 adjacent back end 22 contains a hexagonal opening, the edges of which form a socket 36, preferably three eights of an inch in size, or is sized for fitting snugly around ⅜" fastener hex-heads such as on nuts and bolts. Socket 36 in the example shown can be considered an open-end wrench. Additional hexagonal openings forming sockets may be provided in the sidewalls of housing 12 for greater versatility of the tool, such as the socket 38 shown in most of the drawing figures in broken lines along the right side 30 of housing 12, which is depicted as one quarter inch in size.

Figure 2:
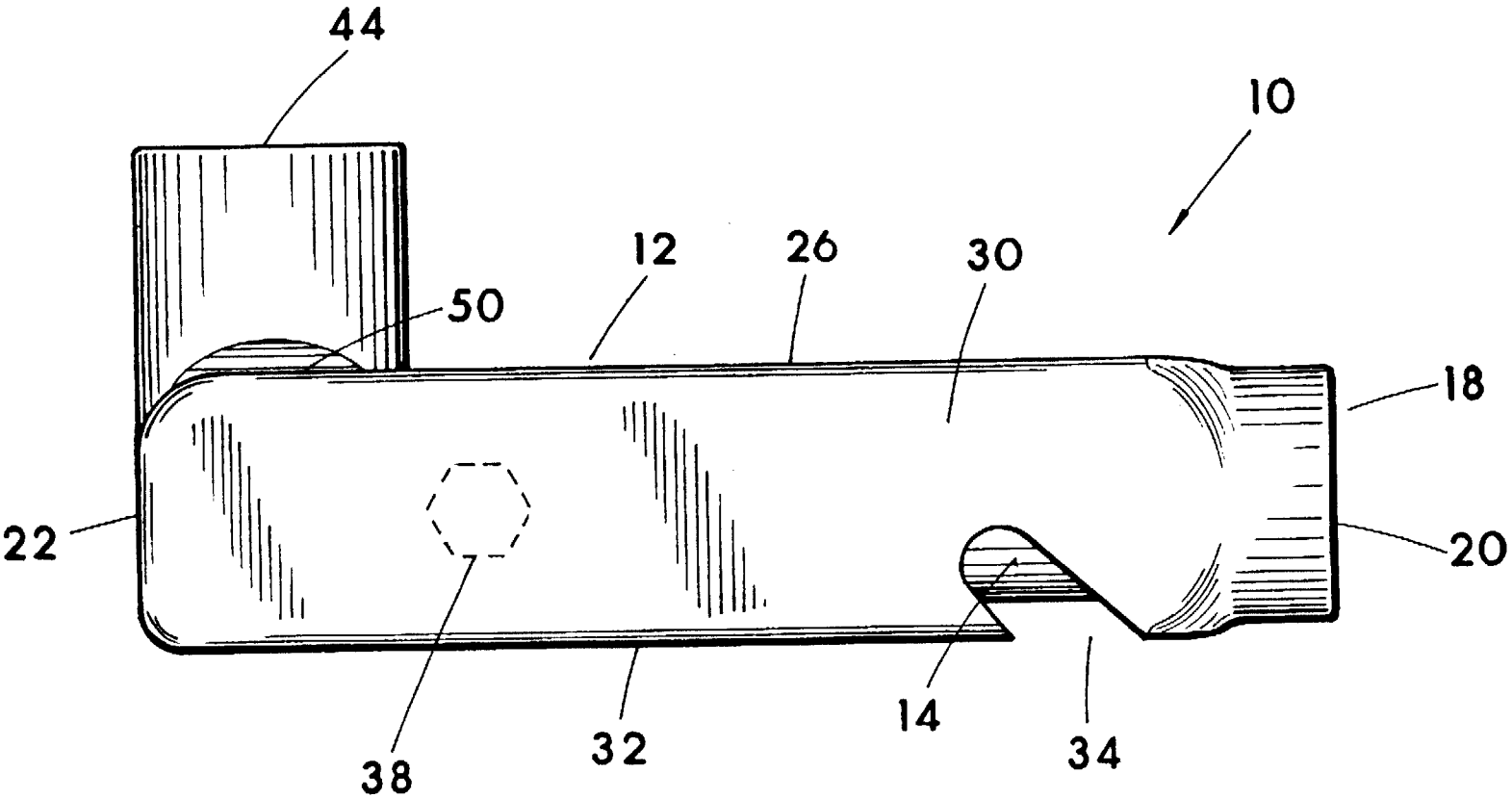
Figure 7:
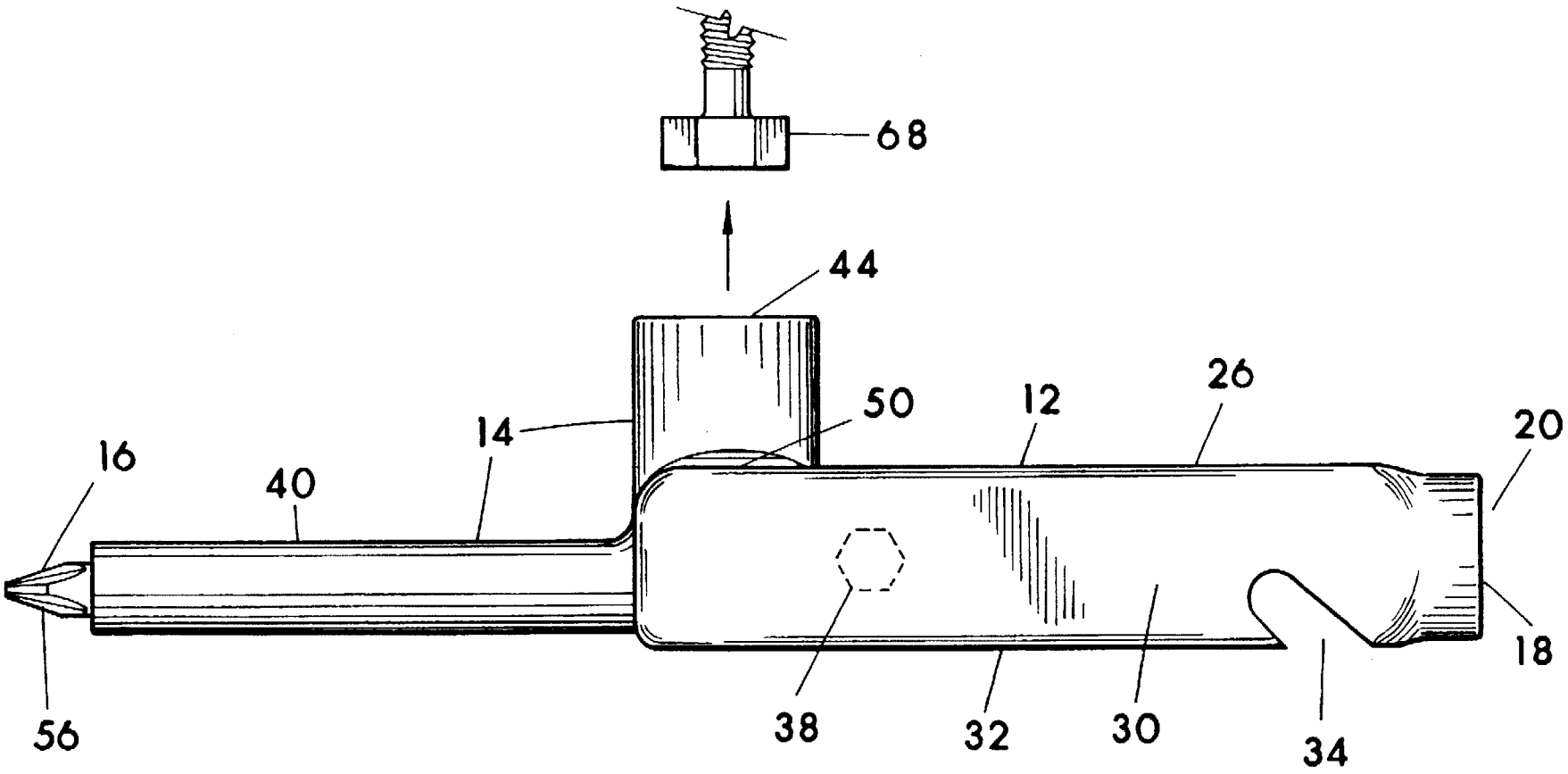
Figure 8:
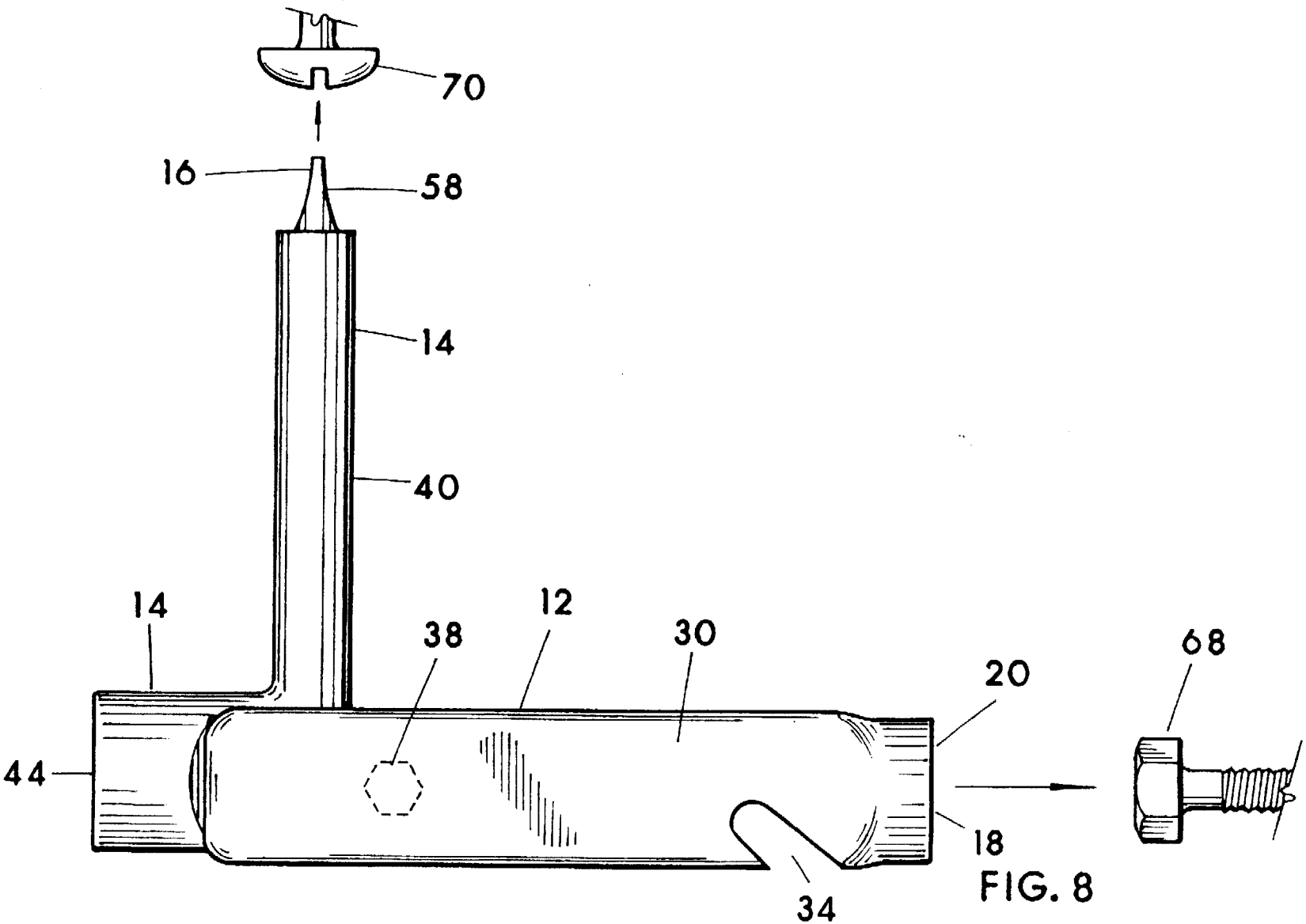

Pipe 14 primarily includes an elongated cylindrical hollow stem 40 defined by an annular sidewall which is rigid and strong, approximately ⅜ inch in diameter, having one open end 42 (see FIG. 1) which serves as a mouth piece end or mouth end to be engaged by the smoker's lips when pipe 14 is used to smoke tobacco. An oppositely disposed end of stem 40 from end 42 is engaged with or affixed with an annular sidewall defining a bowl/socket 44 for receipt of tobacco, and for use as a tool for manipulating nuts and bolt heads. The annular wall of the bowl/socket 44 extends at a right angle to the lengthwise axis of stem 40. The annular sidewall of bowl /socket 44 terminates at its distal end to define an open top mouth of the bowl/socket 44, with the sidewall including flat areas in the interior of the bowl defining a hexagonal socket, the socket preferably 9/16 of an inch in size, for fitting a 9/16" nut or hex bolt head. The affixment of stem 40 to bowl/socket 44 can be made by integral casting of the two together, or by welding the two together or any other suitable connection. The hollow interior 46 of stem 40 is adapted with six equidistant longitudinal grooves 48 which help retain screw driver rod 16 and prevent axial rotation of rod 16 when being used to rotate fasteners such as screws, which will be further understood with continued reading. The cylindrical elongated portion of stem 40, approximately three inches in length, also serves as a lever for providing torque when utilizing tool 10 in some application, which will also become better understood with continued reading. Bowl/socket 44 affixed to one end of stem 40 of pipe 14 has two sets of short grooves in the exterior sides thereof. One set of grooves are located one groove on each side of bowl/socket 44 around the midsection thereof and are referred to as horizontal retaining grooves 50. The second set of grooves shown in FIG. 1 are located one vertical groove on each side of bowl/socket 44 adjacent the elbow joint of bowl/socket 44 and stem 40 and are referred to as vertical retaining grooves 52. In FIG. 1, pipe 14 includes a horizontal groove 50 and a vertical groove 52, and although the second vertical groove 52 is not shown in the drawings, the second vertical groove 52 is on the opposite side of the pipe 14 and in the same position on the exterior of bowl/socket 44. The pair of vertical grooves 52 allow the bowl/ socket 44 to be inserted into the receiving notch 24 wherein the notch 24 and specifically the lips 28 thereof fit in groove 52 and prevent the bowl/socket 44 from rotating relative to housing 12, a configuration wherein the housing 12 and pipe 14 assume a generally L-shape which provides the user good leverage as shown in FIG. 8 for grasping and using certain provided sockets and or one of the provided screw driver tips. Horizontal retaining grooves 50 are structured for insertion over the two small lips 28 located on the edges of the sides 30 within receiving notch 24 of housing 12. Horizontal retaining grooves 50 help retain pipe 14 in a longitudinal storage position within housing 12 as may be ascertained from FIGS. 2 and 3 wherein the lengthwise axis of the housing is parallel to the lengthwise axis of the stem 40, or alternatively help retain the pipe and its sockets in a socket or screw driver use position wherein the housing 12 serves as a leverage providing handle as seen in FIG. 7, again wherein the lengthwise axis of the stem 40 is parallel to the lengthwise axis of housing 12. In FIG. 7, housing 12 via the open space provided by receiving notch 24 and lips 28 fitting snugly in horizontal grooves 50 prevents bowl/socket 44 from rotating relative to housing 12, and in the shown FIG. 7 configuration, pipe 14 and specifically the exterior surface of the sidewall of bowl/socket 44 engaged with housing 12 assumes a generally T-shape wherein the housing 12 and the stem 40 can be used as leverage providing handles for rotating bowl/socket 44 to drive a fastener such as bolt 68 with substantial force.

Figure 9:
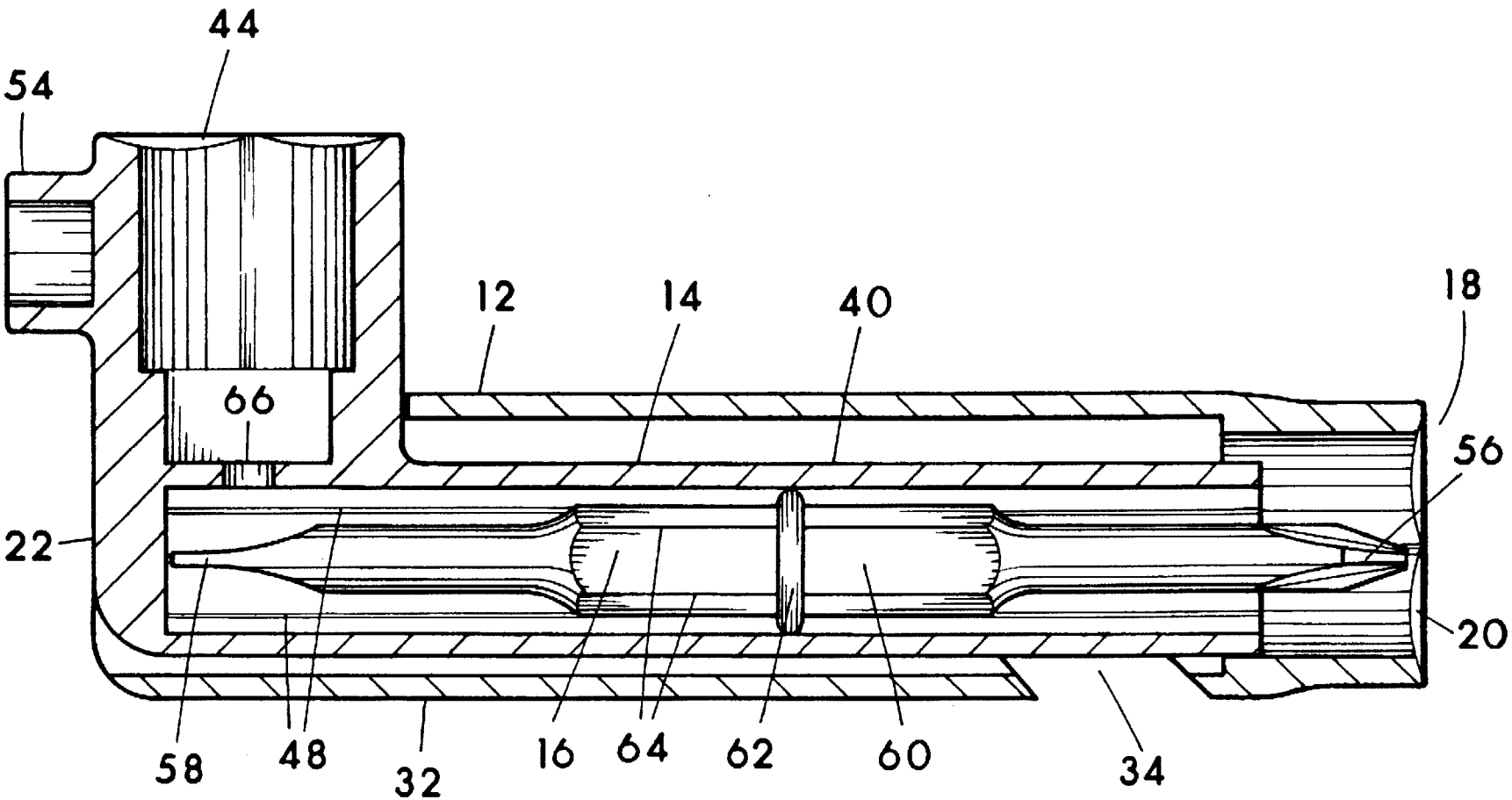

An optional accessory socket 54 is shown in FIG. 9 affixed by integral casting or by welding to the back surface of bowl/socket 44.

Screw driver rod 16 is an elongated section of steel about three inches in length having one end formed into a phillips screwdriver 56 with the opposite end formed into a straight blade screwdriver 58. Screw driver rod 16 is sized for removable reversible insertion into the hollow interior 46 of stem 40 with a small portion of either end of the screw driver, about one quarter inch, projecting past open end 42 of stem 40 for use of screwdrivers 56 or 58. The exposed end of screw driver rod 16 when fully inserted into stem 40 allows the user to grasp the end between his fingers to extract the rod 16 from the stem 40 such as for flipping the rod 16 end-for-end to use the other screw driver tip or for opening the stem 40 for using pipe 14 for smoking tobacco or any other legal substance. The central portion or midsection 60 of rod 16 is hexagonal in shape and is centrally affixed with a compressible and resilient "O"-ring 62 which is seated in a transverse annular groove of rod 16. "O"-ring 62 functions to frictionally retain rod 16 inside the hollow interior 46 of stem 40 of pipe 14 until manually removed. Although "O"-ring 62 is preferable due to lower cost, a spring detent ball or pin is also acceptable as an optional frictional retaining means. The interior of stem 40 contains several parallel longitudinal grooves 48 sized, shaped and positioned for retaining the outer edges or longitudinal corners 64 of the hexagonal midsection 60 of screw driver rod 16 and therefore functions as an indexing tool to prevent rotation of rod 16 within stem 40 during use. To allow tobacco smoking and to prevent "O"-ring 62 from creating an air-tight seal against the interior wall surface of stem 40, an air opening 66 is provided in stem 40 wall directly under bowl/socket 44 located on the exterior of stem 40 opposite to open end 42. Opening 66 communicates between the open interior of bowl/socket 44 and the open interior 46 of stem 40, therefore allowing any release of pressure or vacuum which may occur when withdrawing or inserting screw driver rod 16, and also providing a path through which smoke and air from burning tobacco in bowl/socket 44 may be drawn into and through stem 40 and out through open end 42 when the pipe 14 is being used to smoke tobacco.

There are several different assembly or use positions for pipe 14 and housing 12 which perform or provide different functions. To utilize socket 20 on the end of housing 12, pipe 14 may be inserted into housing 12 in the storage position, with stem 40 positioned within housing 12 with rod 16 removed, and bowl/socket 44 seated within receiving notch 24. Rod 16 should be removed since the end of screwdriver 56 or 58 will extend into the interior of socket 20 and prevent insertion of socket 20 over a correspondingly sized nut or bolt 68. Bowl/socket 44 can also be used with pipe 14 inserted backwards into housing 12, with stem 40 positioned longitudinally but away from housing 12 as shown in FIG. 7. Housing 12 is retained in position by horizontal grooves 50 engaging lips 28 of receiving notch 24 of housing 12. In this position rod 16 may be left within stem 40 and screwdrivers 56 or 58 can also be used to tighten or loosen screws 70.

To gain more leverage to utilize the socket of bowl/ socket 44 or socket 20 or even screwdrivers 56 or 58, bowl /socket 44 is inserted into receiving notch 24 of housing 12 with vertical retaining grooves 52 inserted over lips 28. Stem 40 is now positioned at a right angle to housing 12 which allows pipe 14 to serve as a lever to increase the amount of torque applied to remove the corresponding nut or bolt 68. Housing 12 serves as the lever when utilizing screwdrivers 56 or 58 in this assembly position.

While socket 20 may be used with housing 12 by itself, and socket of bowl/socket 44 used with pipe 14 by itself, the two members of pipe 14 and housing 12 together help provide torsion and a gripping surface for easier manipulation of fasteners.

Figure 3:
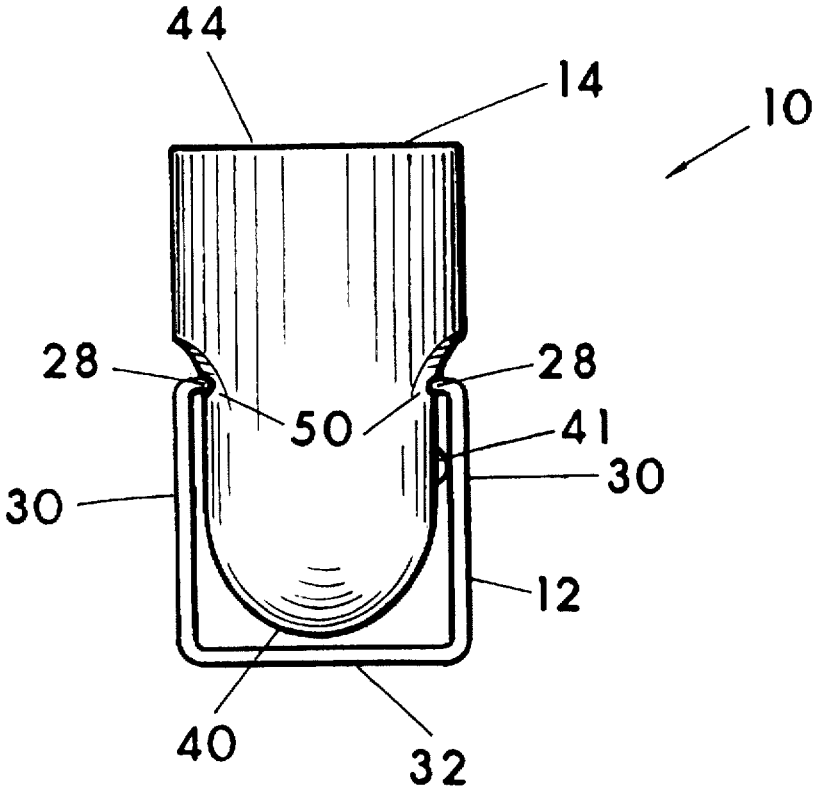
Figure 4:
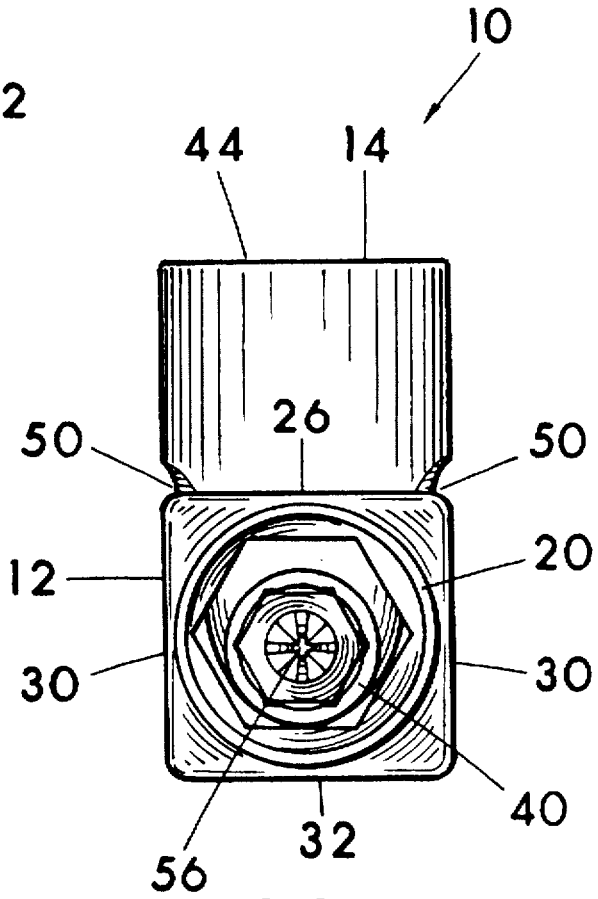
Figure 5:
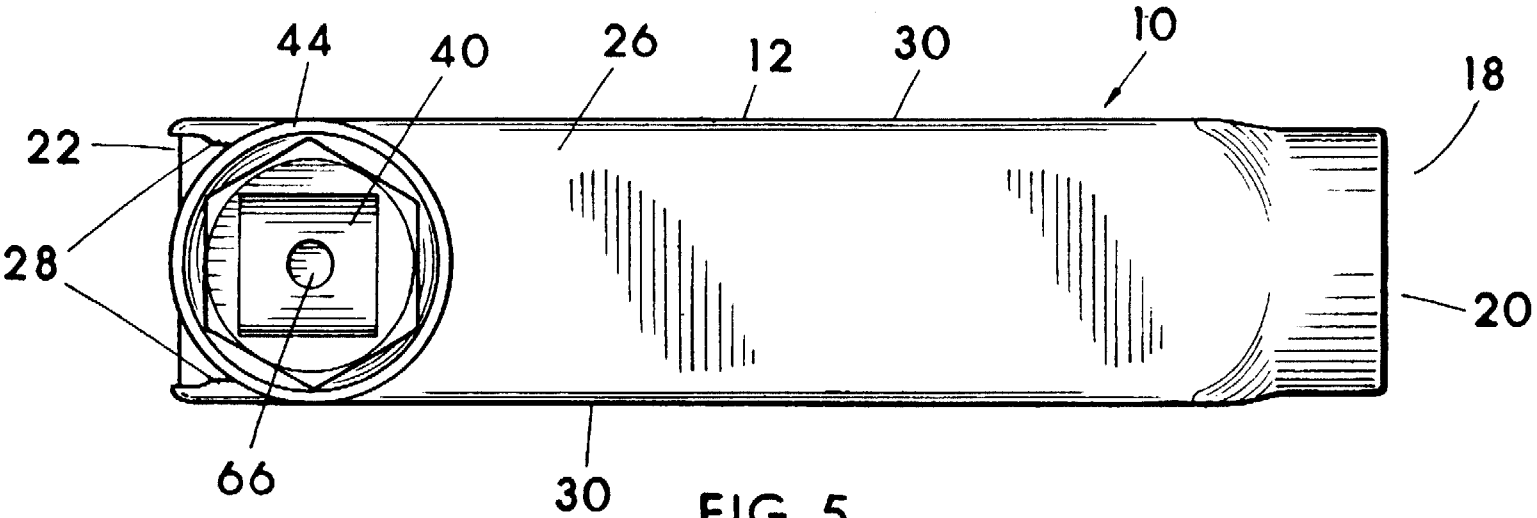
Figure 6:
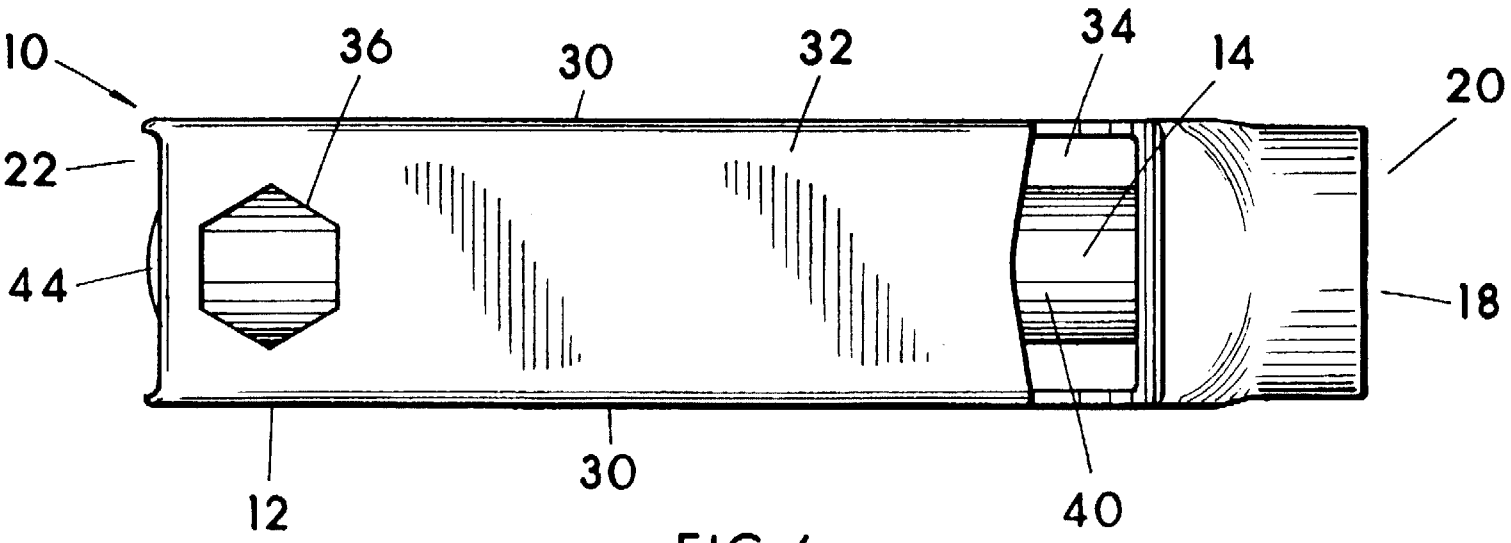

For storage or transportation purposes, rod 16 is inserted into stem 40 of pipe 14 and maintained in position by "O"-ring 62, with stem 40 of pipe 14 being inserted into housing 12 and maintained in position with the insertion of horizontal retaining grooves 50 over lips 28 wherein bowl/socket 44 is at least partially inserted into notch 24 and thus housing 12. An outward extending ball, outwardly biased by a spring, the spring allowing inward depressing of the ball with force, herein referred to as spring ball detent 41 is preferably affixed at the side base of bowl/socket 44 as shown in FIG. 1 so as to press against the interior surface of a sidewall of housing 12 as shown in FIG. 3 to create friction and help retain pipe 14 stored in housing 12. In this storage position, tool 10 is small enough to fit inside a coat or pants pocket which allows it to be carried with the person while he or she is skateboarding or snow boarding, or some other activity where they may be away from a tool box. Since tool 10 supports varying sockets in sizes which are compatible with nuts and bolts found on the majority of skateboards and snow boards in use today, and both screwdrivers 56 and 58 are of sizes suitable for use with screws also found or which may be found in the future on these two items, tool 10 therefore provides many of the individual tools within one unit which could be required to make a necessary adjustment. This eliminates transporting of various tools which could get lost, or the borrowing of tools which many people and ski resorts frown on. Individual tools such as screwdrivers are also sharp and could conceivable cause injury to the skier or skater during a fall. All the sharp ends or extending points of tool 10 are concealed within housing 12 which greatly reduces the possibility of injury.

Although we have very specifically described preferred structures and use of the invention, it should be understood that changes in the specific structures described and shown in our drawings may clearly be made without departing from the true scope of the invention. For example, it should be realized that not all of the sockets and screw driver tips described in the preferred embodiment are absolutely required in a tool embodiment that is in accordance with the present invention, as fewer or additional sockets and tips could be applied to a tool within the true scope of the invention in accordance with the appended claims. Additionally, we anticipate changing the sizes and shapes of the specific wrenching tools, i.e. sockets and screw driving tips to fit or function with fasteners which are periodically changed or simply varying in sizes and types from various manufacturers of equipment, so that our tool will be useful within its intent.

Another anticipated change is that with some reshaping of housing 12 and pipe 14 to provide necessary clearances, we believe pipe 14 and housing 12 could be connected to one another with a pivot pin in the area of spring ball detent 42, the detent 42 being eliminated and replaced with a rivet or lose-fit pin or the like tying that end of the housing 12 to the pipe bowl/socket 44, an arrangement wherein with the elimination of notch 24 and top surface 26 of housing 12 to leave housing 12 having three connected sides and an open top slot, pipe 14 could be permanently connected to housing 12 and stem 40 with pivoting of the pipe on the pivotal connection to housing 12 could be swung into the open top side of housing 12 or swung out of housing 12 similar to storing and exposed a knife blade of a pocket knife.

Furthermore, we have not shown a drawing of a skateboard or a snow board or a beverage bottle and cap because these items are notoriously well known.

We claim:

1. A combination smoking pipe and fastener manipulating tool comprising;

a hollow stem defined by a rigid sidewall having an open mouth end structured as a tool socket for grasping nuts and bolt heads;

a bowl structure engaged on said stem and including a sidewall extending approximately 90 degree from said stem and defining an open mouth with the sidewall of said bowl structured as a tool socket for grasping nuts and bolt heads;

an open pathway from said mouth end of said stem through said stem into said bowl;

an elongated multi-tipped screw driver rod removably insertable into said stem through said mouth end of said stem;

means within said stem engagable with said screw driver rod when inserted into said stem for preventing axial rotation of said screw driver rod relative to said stem;

grooves in an exterior surface of said sidewall of said bowl;

an elongated tubular housing of rigid material having a tool socket at one end for grasping nuts and bolt heads, and another tool socket at an opposite end of said housing for grasping nuts and bolt heads;

a receiving notch in said housing sized to allow insertion of said bowl at least partially into said receiving notch, said receiving notch partially bordered by inward extending lips of said rigid material of said housing with said lips sized to fit into said grooves of said sidewall of said bowl;

said stem sized relative to said housing so as to be insertable into said housing with said bowl at least partially inserted into said receiving notch.

2. A combination smoking pipe and fastener manipulating tool in accordance with claim 1 further including an exposed slot in said rigid material of said housing for use in prying a beverage bottle cap.

3. A smoking pipe with fastener manipulating tools comprising;

a smoking pipe useful for smoking tobacco, said pipe including a hollow stem defined by a rigid sidewall having an open mouth end structured as a first tool socket; said pipe further including a bowl structure engaged on said stem and including a sidewall extending from said stem and defining an open mouth for receipt of tobacco and with the sidewall of said bowl structured as a second tool socket for grasping nuts and bolt heads; an open pathway from said mouth end of said stem through said stem into said bowl;

an elongated tubular housing of rigid material having a receiving notch in said housing sized to allow insertion of said bowl at least partially into said receiving notch and thus said housing;

said pipe storable within said housing with said stem inserted into said housing with said bowl at least partially inserted into said receiving notch.

4. A smoking pipe with fastener manipulating tools in accordance with claim 3 further including a screw driver rod removably insertable into said stem through said mouth end of said stem;

means within said stem engagable with said screw driver rod when inserted into said stem for preventing axial rotation of said screw driver rod relative to said stem.

5. A smoking pipe with fastener manipulating tool comprising;

a smoking pipe useful for smoking tobacco, said pipe including a hollow stem defined by a rigid sidewall having an open mouth end; said pipe further including a bowl structure engaged on said stem and including a sidewall extending from said stem and defining an open mouth for receipt of tobacco; an open pathway from said open mouth of said stem through said stem into said bowl;

at least one said open mouth of said pipe structured as a tool socket for grasping nuts and bolt heads;

an elongated tubular housing having a lengthwise axis;

means for engaging said housing to the sidewall of said bowl with said lengthwise axis of said housing parallel to a lengthwise axis of said stem of said pipe.

* * * * *